US005525964A

United States Patent [19]

Ming

[11] Patent Number: 5,525,964

[45] Date of Patent: Jun. 11, 1996

[54] ELECTRONIC LOCKING DEVICE

[76] Inventor: Wang S. Ming, No. 61, Alley 668, Yu-Nong Rd., Tainan City, Taiwan

[21] Appl. No.: 366,925

[22] Filed: Dec. 30, 1994

[51] Int. Cl.[6] ..... E05B 45/06

[52] U.S. Cl. ..... 340/542; 340/427; 340/432; 70/57.1; 70/21

[58] Field of Search ..... 70/57, 58, 225, 70/416, 276, 278, 283, 432, 57.1, 21; 340/542, 427

[56] References Cited

U.S. PATENT DOCUMENTS 4,546,345 10/1985 Naito ..... 340/542
4,811,578 3/1989 Masoncup ..... 340/542
4,980,667 12/1990 Ames ..... 340/427
5,191,314 3/1993 Ackerman ..... 340/542
5,404,735 4/1995 Hsieh ..... 70/38
5,406,257 4/1995 Saito ..... 340/542

*Primary Examiner*—John K. Peng
*Assistant Examiner*—Albert K. Wong
*Attorney, Agent, or Firm*—Morton J. Rosenberg; David I. Klein

[57] ABSTRACT

An electronic cable lock is provided. The lock includes a sealed lock body having a lock core, and an electronic device enclosed therein. The electronic device includes a sensor which will trigger a buzzer to sound when an attempt to illegally break the lock is sensed.

3 Claims, 16 Drawing Sheets

ELECTRONIC LOCKING DEVICE

BACKGROUND OF THE INVENTION

1. Field of the Invention

This invention relates to a locking device and more particularly to a locking device controlled by an electronic apparatus.

2. Prior Art

In the field of cable lock devices for cycles one known technique for preventing theft of the cycle has been to secure it to an immovable pole or a barrier by a locked cable, as shown in FIGS. 11 and 12. This cable lock includes a lock core A located in a lock body B and a cover C.

The lock body B includes a sleeve B1 and a cap B2. The sleeve B1 has an opening at one end for insertion of the lock core A therethrough and is sealed by the cap B2. A small hole B12 at the opposite end of the opening exposes the keyway of the lock core A. An aperture B11 is formed at one side and adapted to secure a latch A2 of a cable A1 therein. Art aperture B21 is formed at one side of the cap B2 and adapted for the other end of the cable A1 to be inserted therethrough and secured in the lock core A.

The cover C includes a clamp C1 at one end and an opening C2 at the opposite end thereof adapted for the lock body B to be inserted therein. The opening C2 comprises a recess C21 and a neck C22 adapted to secure the lock body B and the latch A2 to an immovable place.

However, such devices enable any person skilled in the art to break the locking device, so long as there is enough time. To overcome this disadvantage the present invention provides an alarm before it is broken illegally.

SUMMARY OF THE INVENTION

It is the primary object of the present invention to provide an electronic locking device which will produce a warning signal to scare a thief before the lock is broken.

It is another object of the present invention to provide an electronic locking device which is a dependable and reliable antitheft device.

It is a further object of the present invention to provide an electronic locking device which is easy to operate.

DETAILED DESCRIPTION OF THE PREFERRED EMBODIMENT

Figure 1:
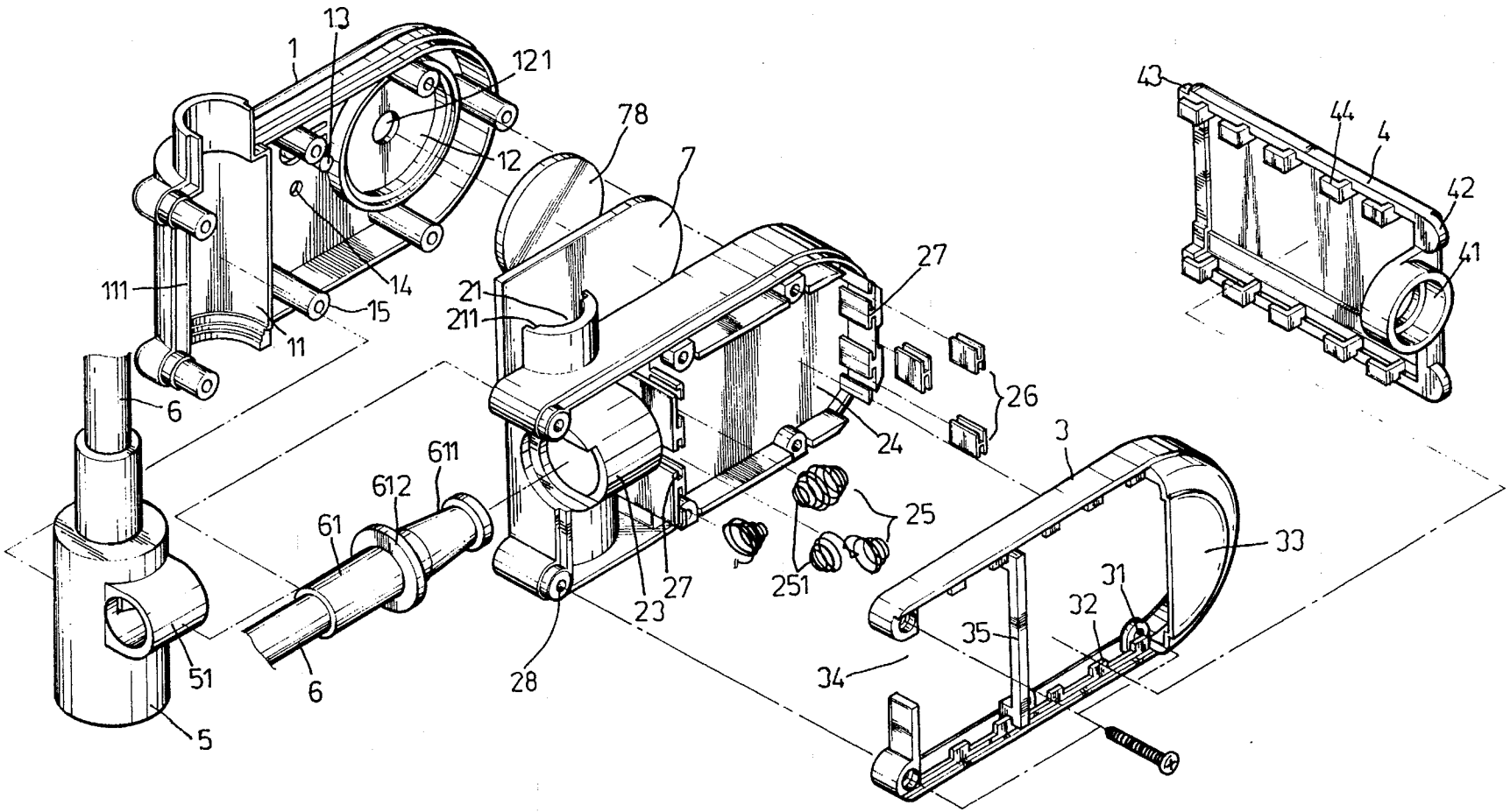
FIG. 1 is an exploded view of the present invention.
Figure 2:
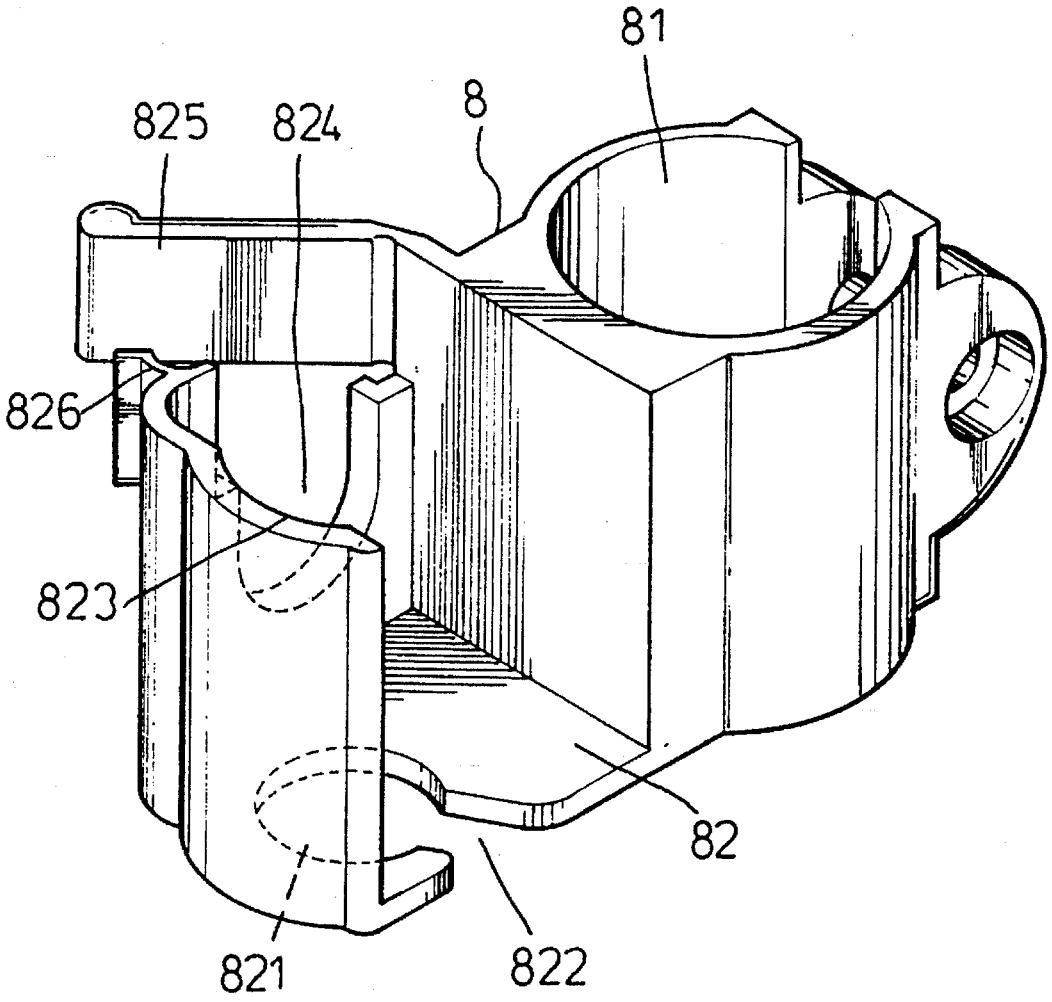
FIG. 2 is a perspective view of the fixture of the present invention.
Figure 3:
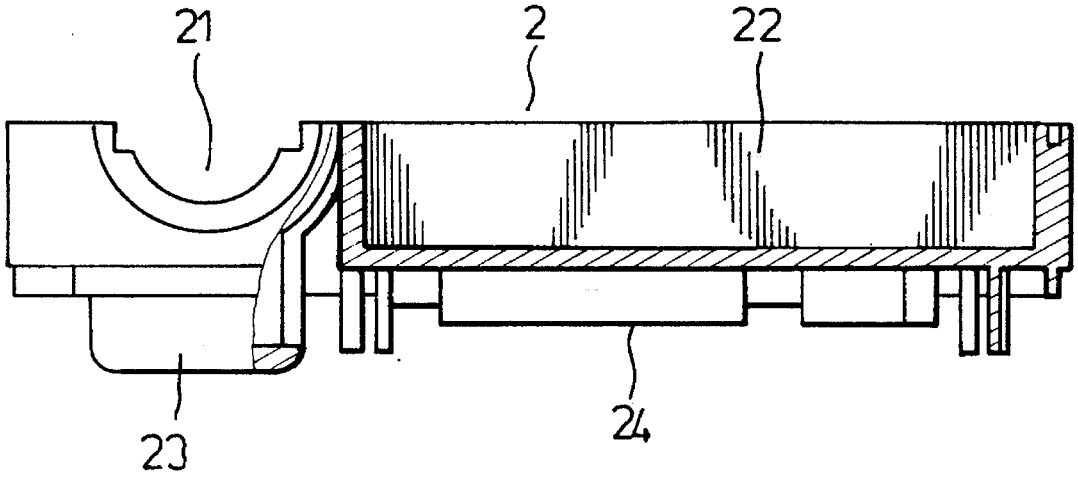
FIG. 3 is a side elevational view of the lock seat of the present invention, partially sectioned.
Figure 4:
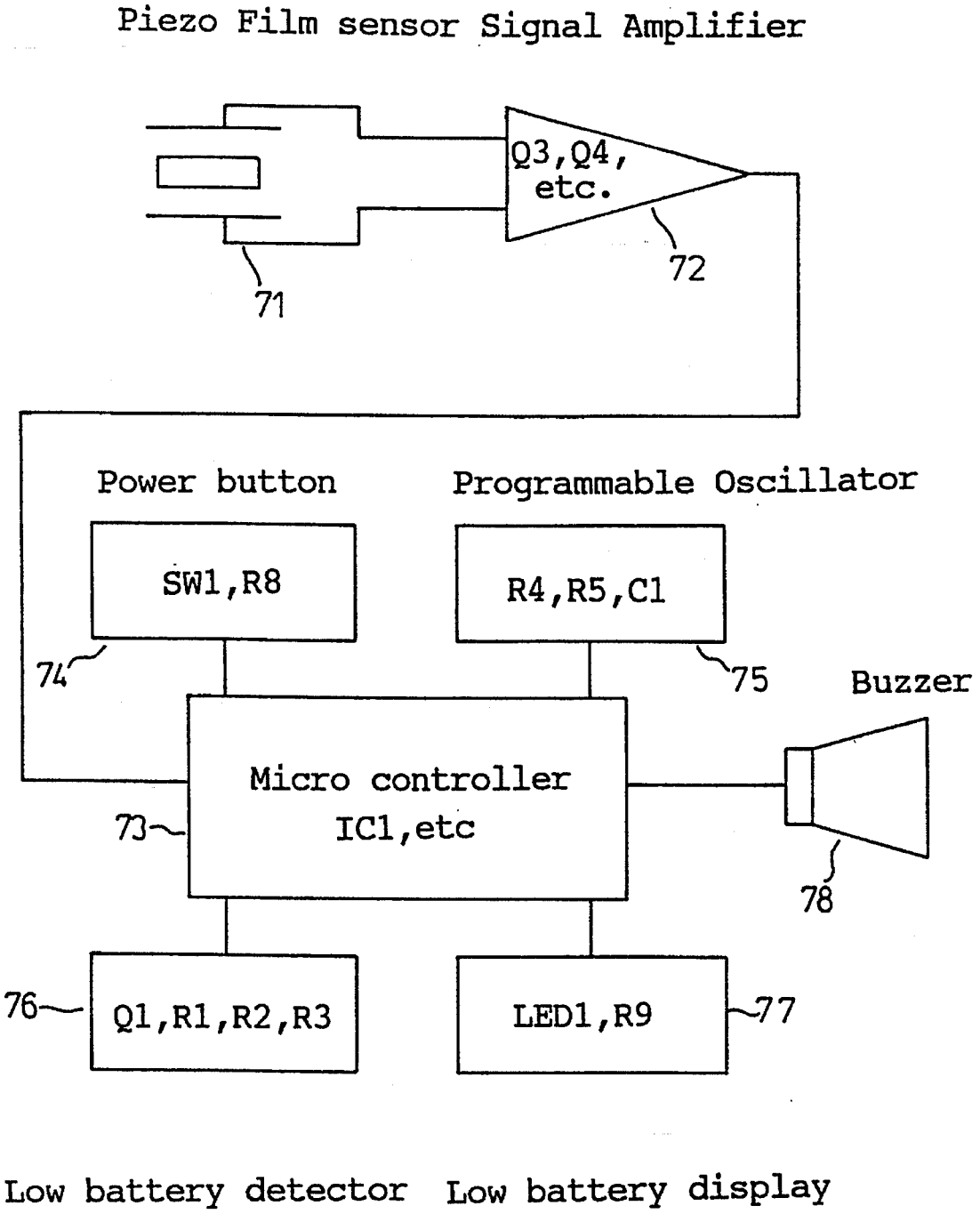
FIG. 4 is a block diagram of an electronic alarm system of the present invention.
Figure 5D:
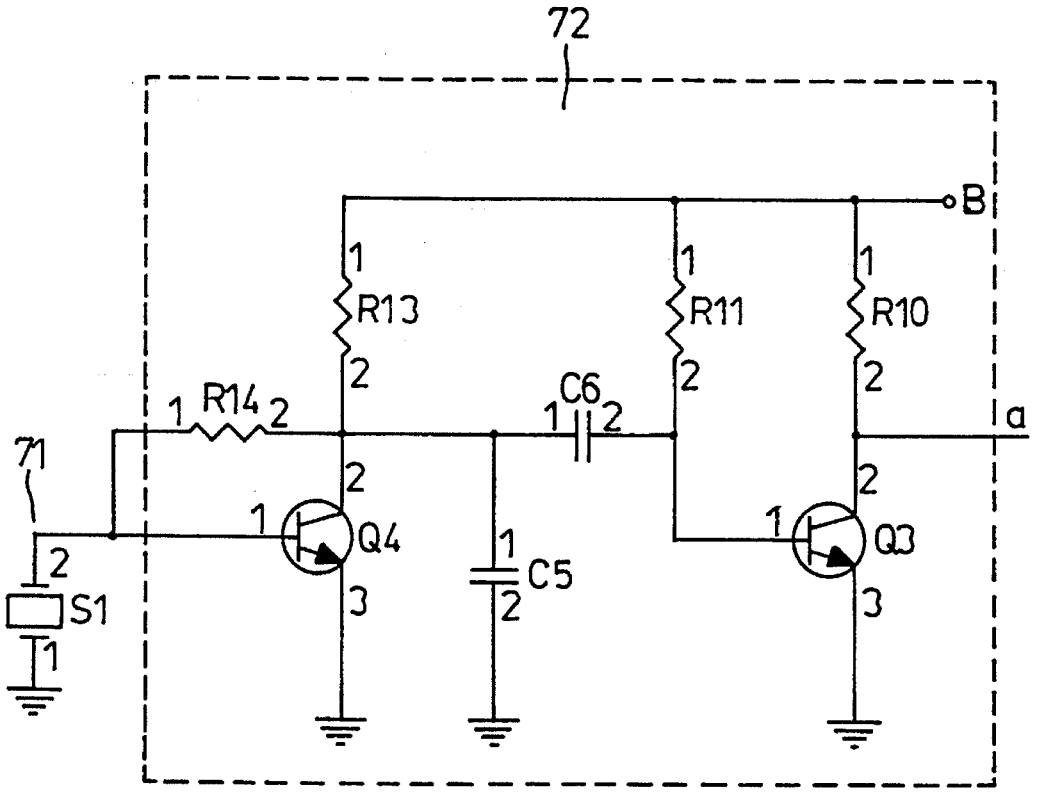
FIGS. 5A–5D are schematic diagrams of the electronic alarm system of FIG. 4.
Figure 5A:
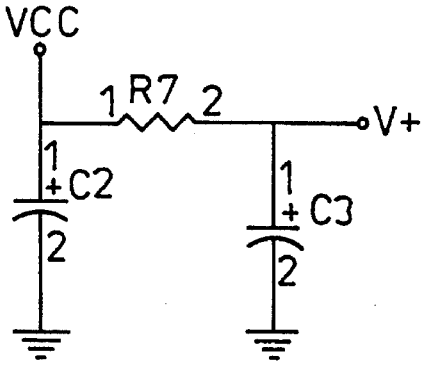
Figure 5B:
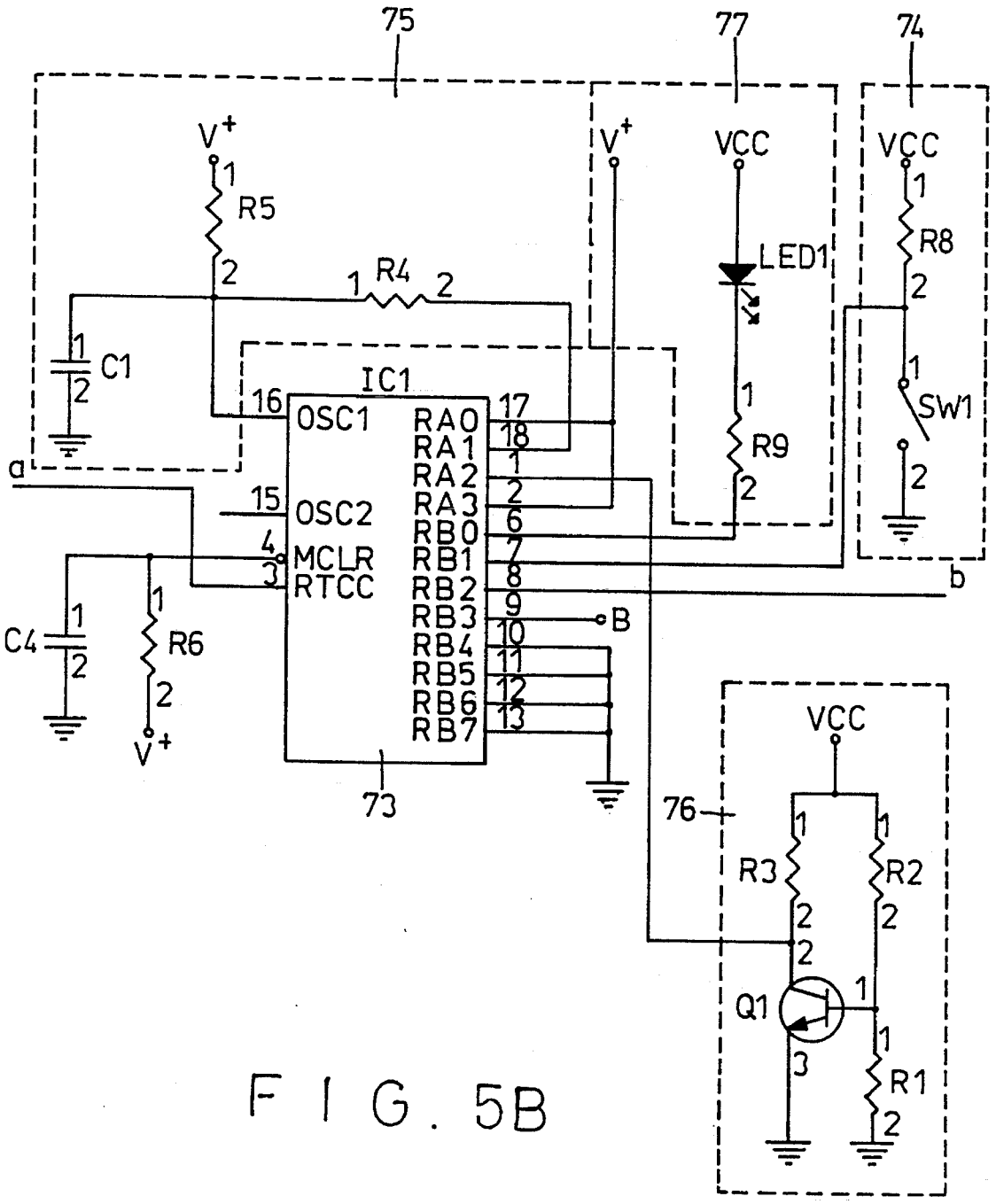
Figure 5C:
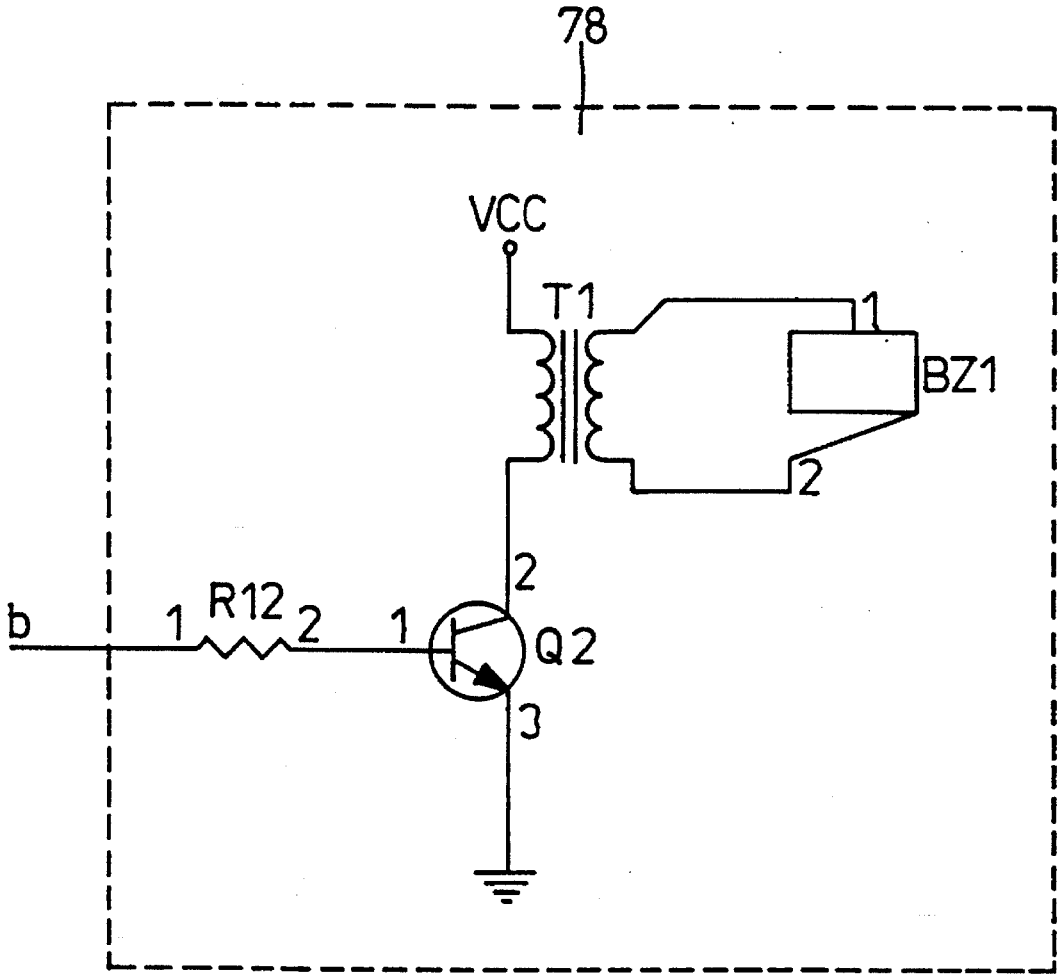

Referring now to FIGS. 1 through 10, there is shown the subject locking apparatus for the purpose of illustrating the preferred embodiments, and not for the purpose of limiting the inventive concept illustrated therein. Referring to FIGS. 1, 2 and 3, there is shown, a base unit 1, a lock core mounting 2 adapted to receive a lock core 5 therein, a cap 3, and a cover 4 to form a housing which encompasses an alarm 7 forming the present invention.

The base unit 1 comprises a semi-circular trough 11 at one end extending at an angle of 90 degrees with respect to the long axis of the base unit and having a pair of leading edges 111 at respective sides thereof. The base unit 1 has a circular groove 12 formed therein and adapted to receive a buzzer 78 of an alarm 7 therein with an aperture 121 being formed at center portion thereof. The base unit 1 also includes a micro-switch 13 adapted to start the alarm 7, an aperture 14 to display a low battery indication 77 of the alarm 7 and a plurality of internally threaded posts 15 at the periphery thereof.

The mounting 2 includes a semi-circular trough 21 at one end thereof, and having a pair of recesses 211 at respective sides of the trough 21 adapted to receive the leading edges 111 of the other semi-circular trough 11, to form a barrel to receive a lock core 5 therein. A recess 22 is formed in one side of the mounting 2, as shown in FIG. 3, and adapted to receive the alarm system 7 therein. The mounting 2 further includes a battery compartment 24 at a side thereof opposite the side having the recess 22. The battery compartment includes coiled springs 25 and plate springs 26 secured to fixtures 27 at respective opposing ends of the battery compartment 24. A barrel 23 laterally offset from the semi-circular trough 21 is adapted to receive a latch portion 61 of the lock cable 6. A plurality of internally threaded posts 28 are formed at the periphery of the mounting 2.

The cap 3 includes a plurality of screw receiving apertures 31 at its periphery adapted to be fastened by fasteners to the mounting 2 and the base unit 1. A plurality of projections 32 project in a longitudinal direction from the upper and the lower surfaces. A semi-circular plate 33 is integrally formed at one end thereof and an opening 34 is formed in the opposite end. A strip 35 is formed at the center portion having its two opposing ends connected to the upper and the lower surfaces of the cap 3, respectively.

The cover 4 includes a hollow barrel 41 extending from one end, a pair of lugs 42 at respective sides of the same end, a pair of cut off portions 43 at respective sides of the end opposing the lugs 42 and adapted to be inserted under the plate 33, and a plurality of clamps 44 at the inner upper and lower edges thereof adapted to be inserted into the projections 32, respectively. The lock core 5 has a cylindrical body having one end connected to an end of a cable 6 and an offset portion 51 to be inserted into the barrel 23 of the lock core mounting 2 so as to receive the latch 61 therethrough. The latch 61 has a circular rim 612 which is adapted to position the latch 61 when it is inserted into the barrel 23. The endmost portion of the latch 61 has a frustro-conical shape and having a portion protruding therefrom forming a neck 611 thereat.

Figure 8:
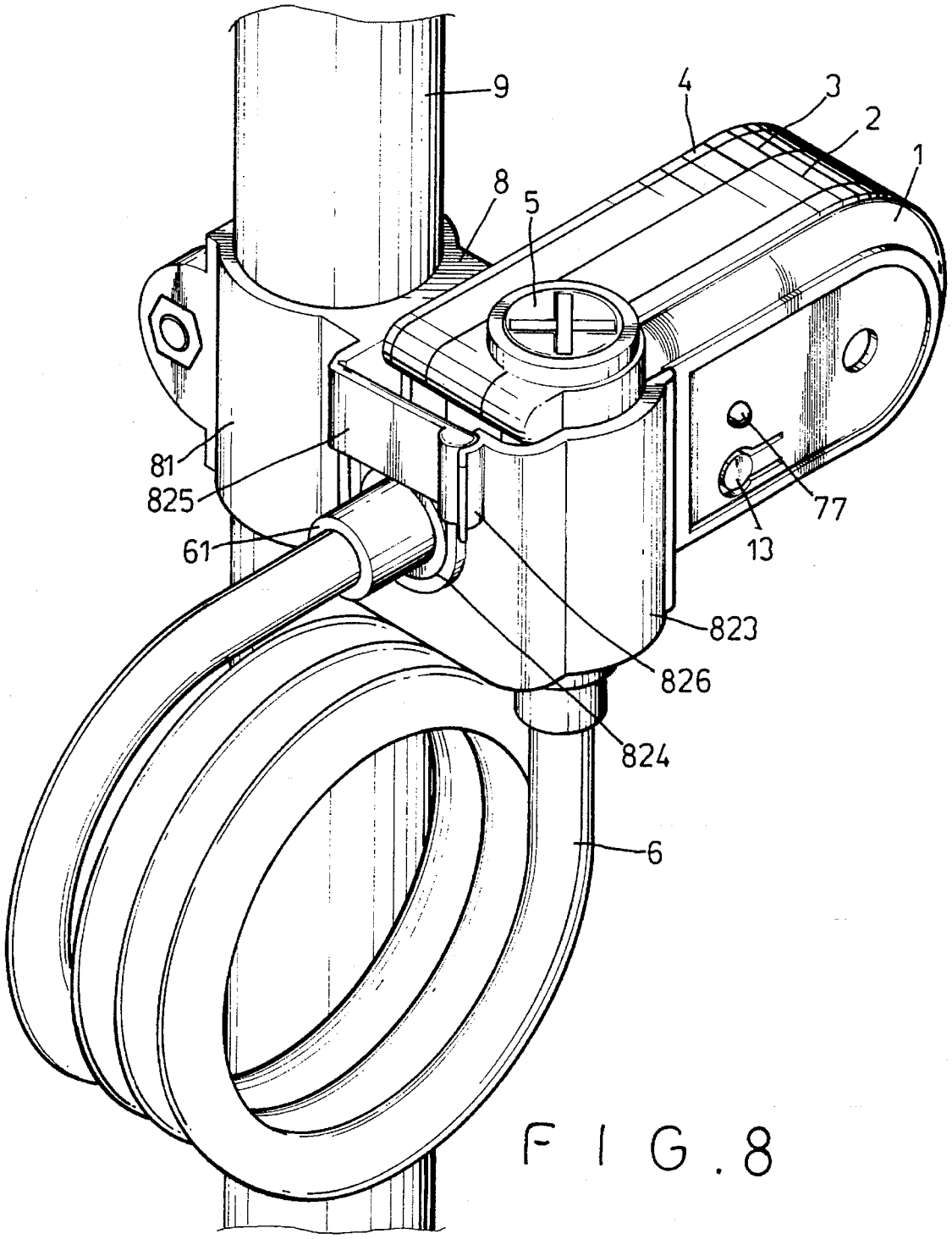
FIG. 8 is a perspective view showing the present invention being secured to an immovable pole.
Figure 9:
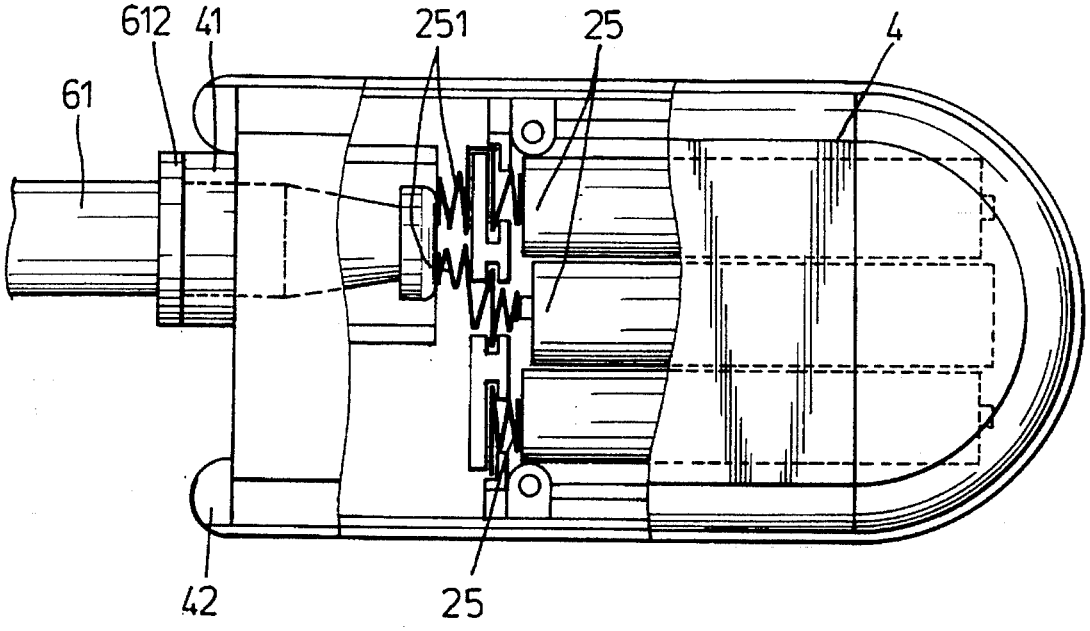
FIG. 9 is a side elevation view, partially cut away, of the present invention.

The fixture 8 is formed with two cylindrical parts which include a clamp 81 at one side and a lock core housing 82 at the opposite side. The clamp 81 is adapted to secure fixture 8 to a post, as shown in FIG. 8. The lock core housing 82 includes an aperture 821 at the bottom portion, from which extends a groove 822 to form an opening to the aperture 821. An arcuate wall 823 is disposed on one side, a notch 824 is formed in another side wall, a gate 825 is hingedly attached to one end of the housing 82, and a latch 826 is formed at an end opposing the hinged end of the gate 825, to secure the free end of the gate 825 thereat.

Figure 10A:
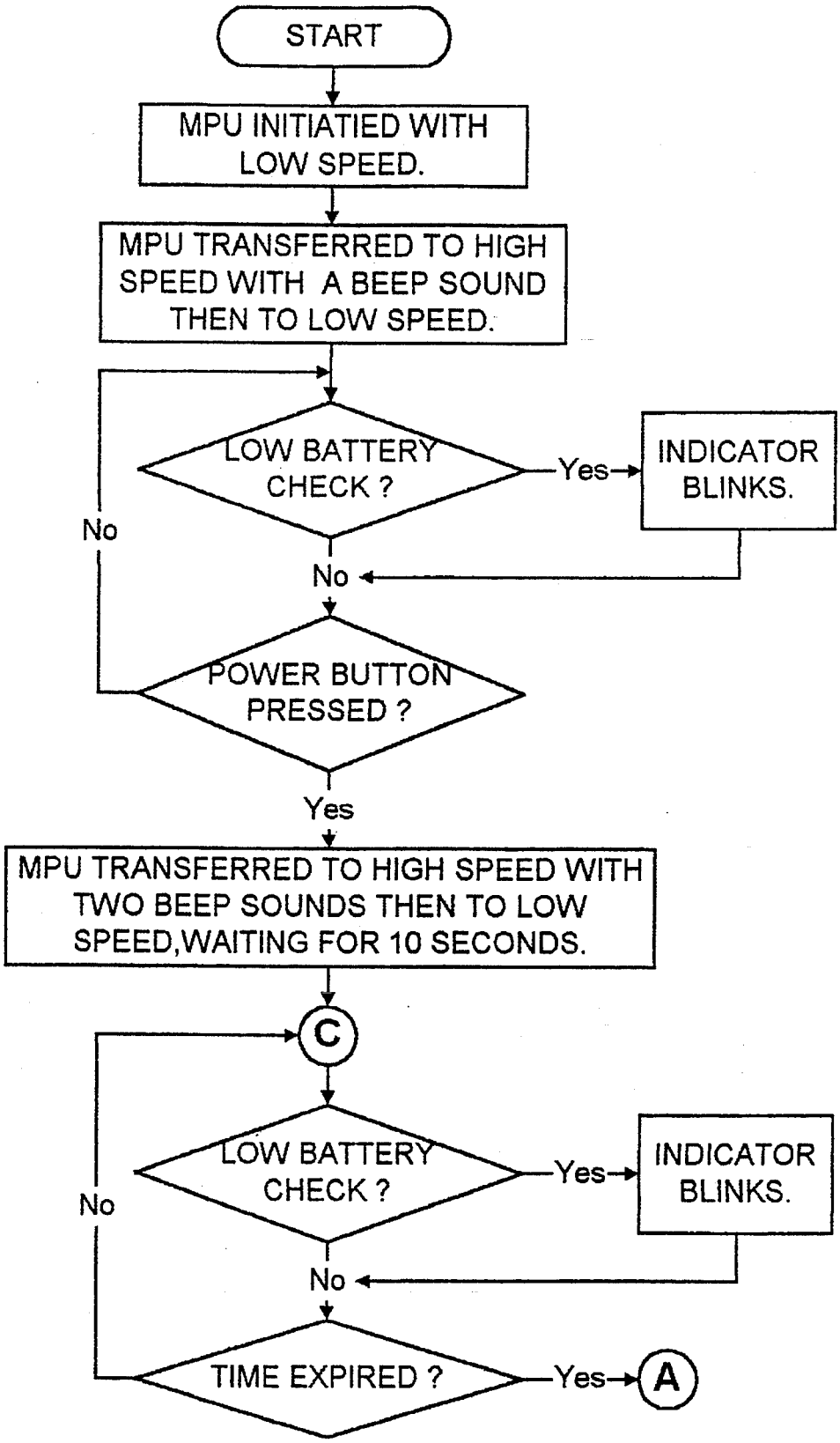
FIGS. 10A–10C are flow charts illustrating the functions performed by the electronic alarm system of the present invention.
Figure 10B:
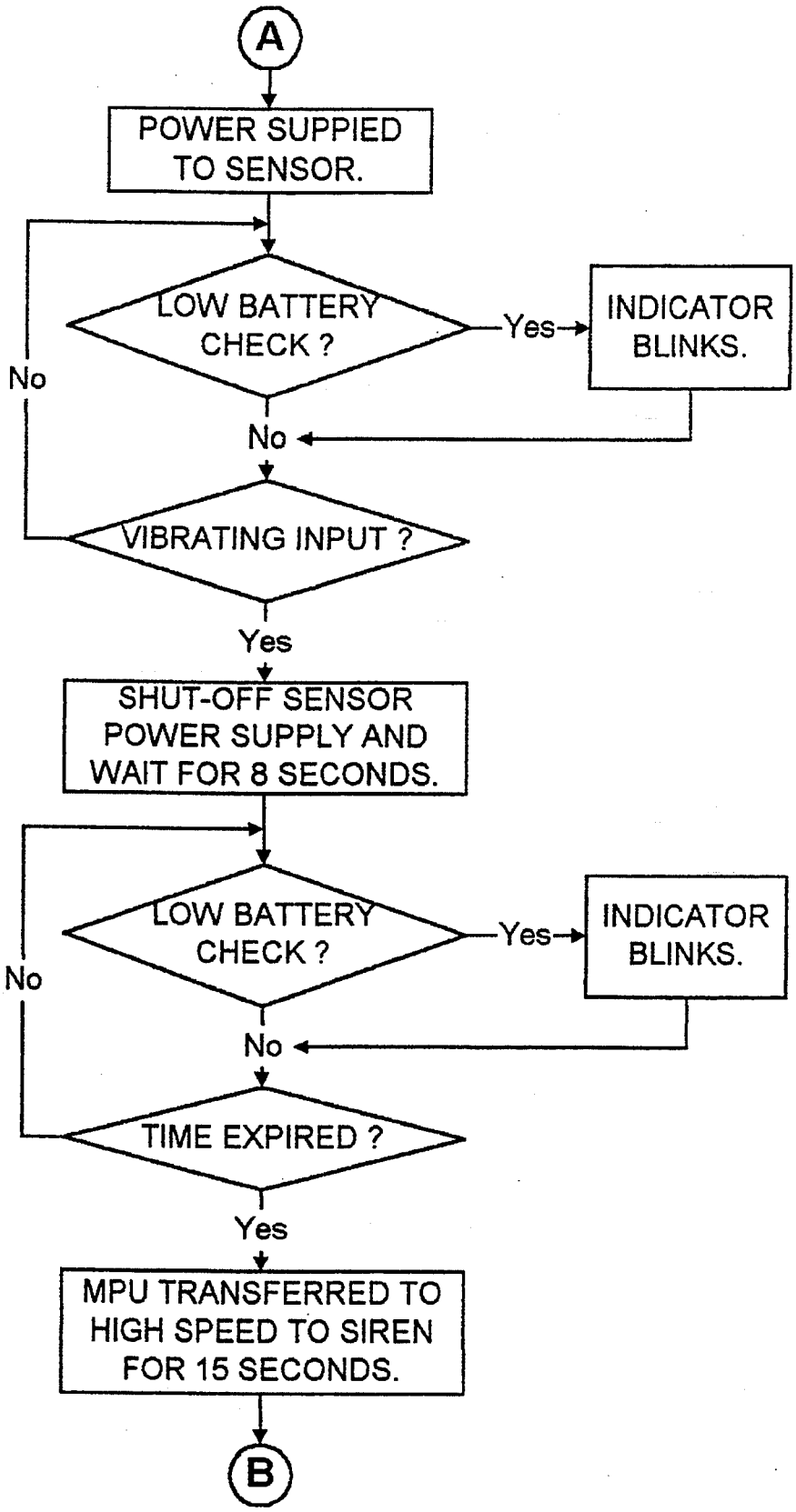
Figure 10C:
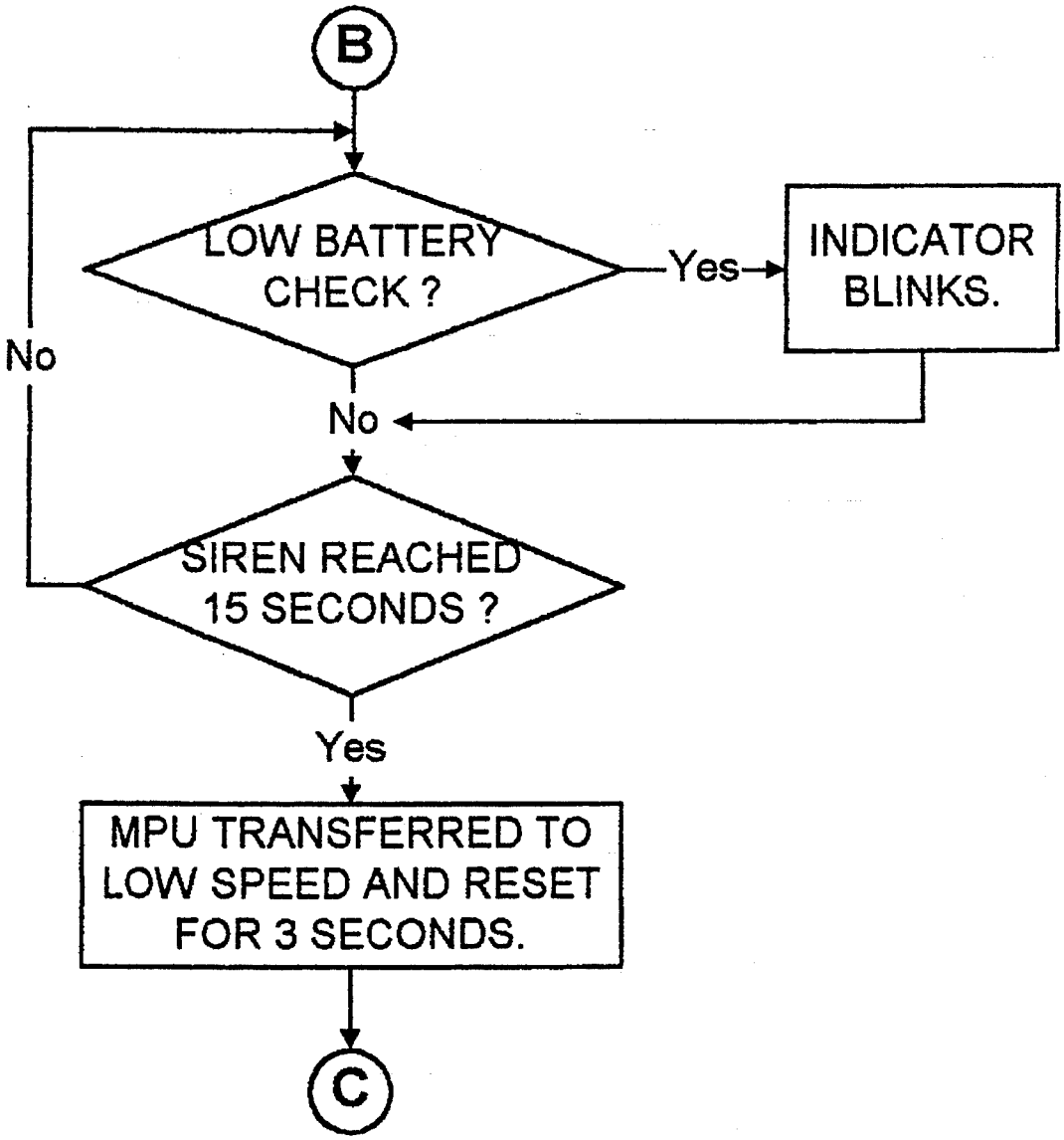
Figure 11:
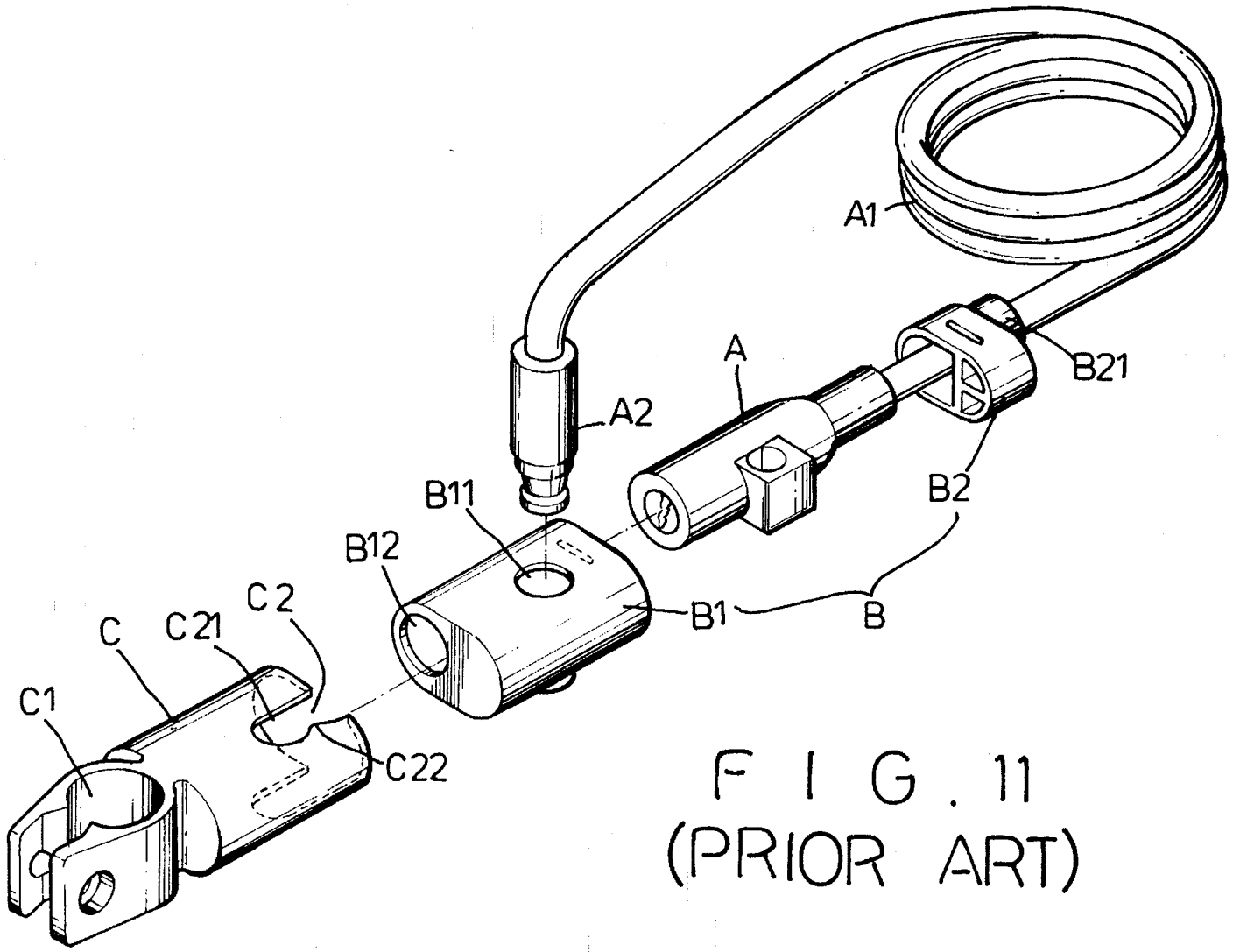
FIG. 11 (PRIOR ART)
FIG. 11 is an exploded view of a prior art.
Figure 12:
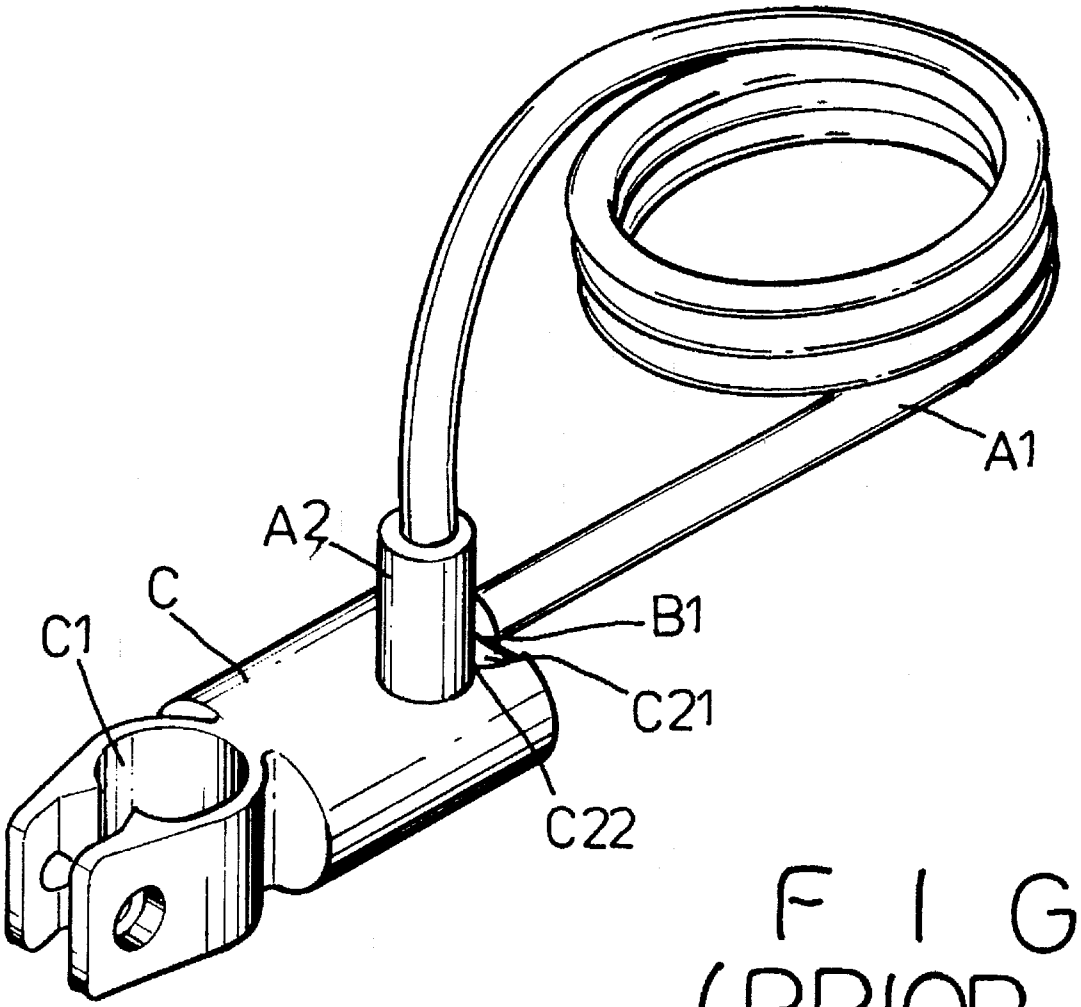
FIG. 12 (PRIOR ART)
FIG. 12 is a perspective view of FIG. 11.

The alarm system 7, as shown in FIGS. 4 and 5A–5D, are composed of a piezo film sensor 71, a signal amplifier 72, a micro controller unit 73, a power button 74, a programmable oscillator 75, a low battery detector 76, a low battery display 77 and a buzzer 78. Responsive to latch 61 being inserted into the boss 23, through the barrel 41, and pressing on the coiled springs 25 at their ends 251, the micro controller unit 7 is initiated to begin the program whose flow chart is shown in FIGS. 10A–10C. The micro controller unit 7 will be transformed from a high speed operation to a lower speed operation by a beep sound.

Figure 6:
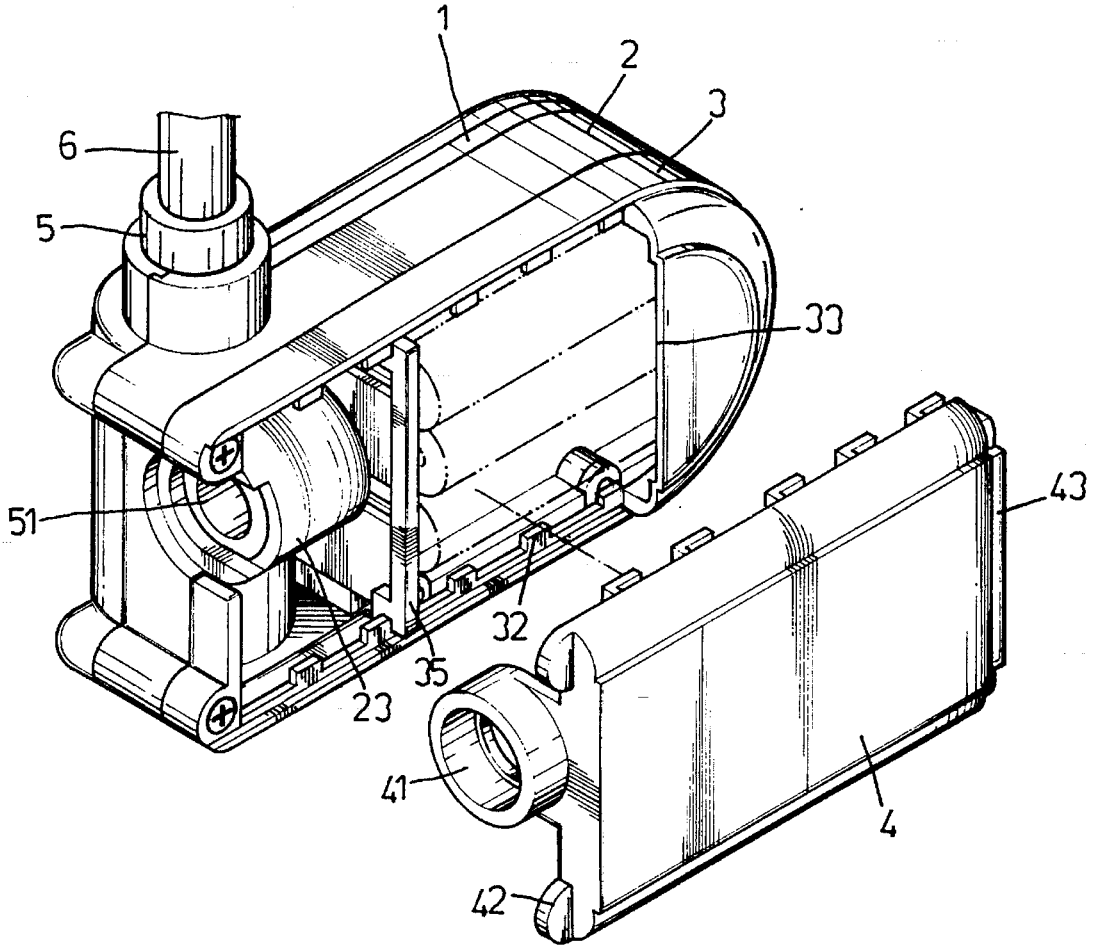
FIG. 6 is a perspective view of the lock body and the cover before assembled.
Figure 7:
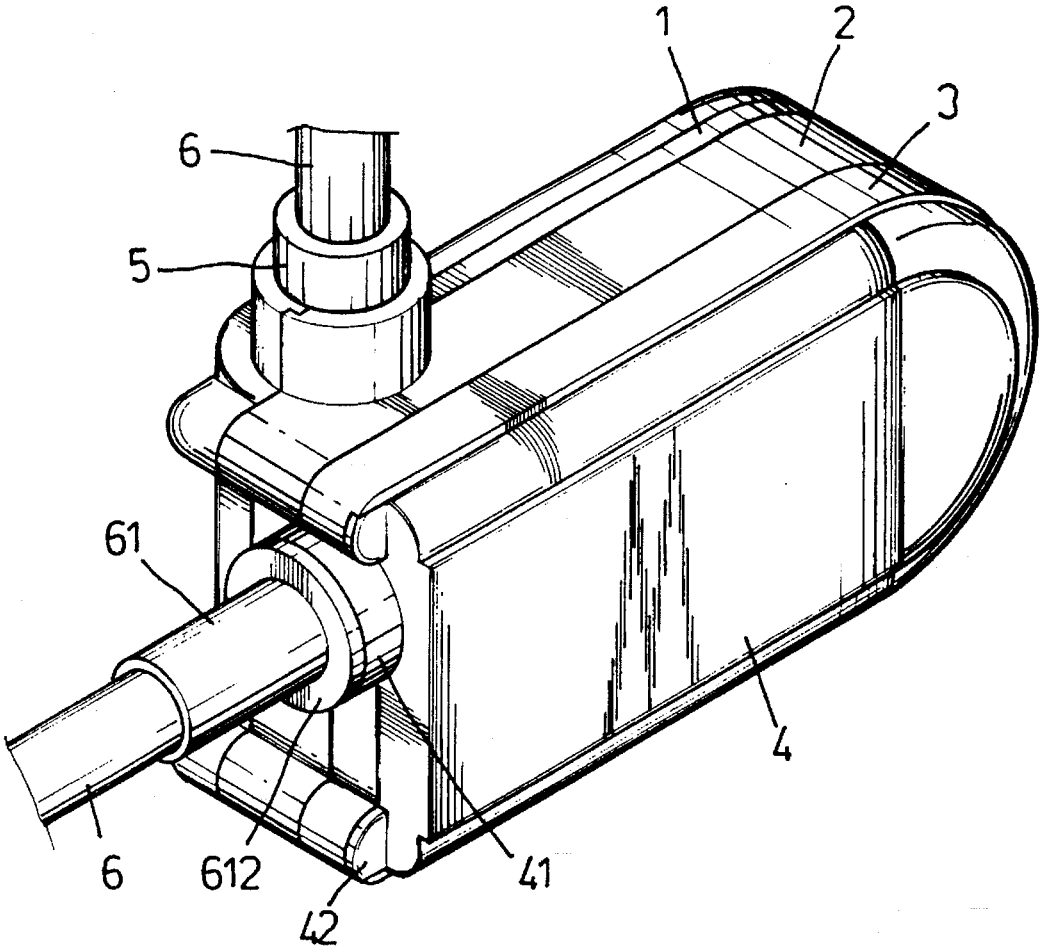
FIG. 7 is a perspective view of the lock of the present invention.

To assemble the present invention, the buzzer 78 is placed in the groove 12, the alarm 7 is placed in the base unit 1. The lock core mounting 2 and the cap 3 are secured to the base unit 1, as shown in FIG. 6. The cover 4 is pressed to the cap 3 and slid to seal tightly, as shown in FIGS. 7 and 8.

To operate the alarm system 7, the micro switch 13 is first pressed to operate the power button 74, which triggers the piezo film sensor 71. Upon sensing vibration of an illegal movement, the piezo film sensor 71 will send a signal to the micro controller unit 73 through the signal amplifier 72 and the piezo film sensor 71 is cut off immediately thereafter. The micro controller unit 73 then compares a predetermined frequency from the programmable oscillator 75 with the signal from the piezo film sensor 71. In the event the predetermined frequency is higher than the frequency received, the micro controller unit 73 will ignore this signal. However, should the predetermined frequency be lower than the frequency received, the micro controller unit 73 will then trigger the buzzer 77 after a predetermined period. The buzzer 77 will sound for a period of time and then stop. The piezo film sensor 71 is activated again after the alarm period ends to repeat the procedure.

The battery is repeatedly tested at each step, automatically, during the above procedure to prevent battery insufficiency.

I claim:

1. A locking device having an alarm, comprising:

a lock core having a cable extending therefrom, said cable having a latch formed on a distal end thereof for releasable coupling within a bore formed in a side portion of said lock core;

a housing assembly including (1) a lock core mounting member having opposing first and second sides, (2) a base member coupled to said first side of said lock core mounting member, (3) a cap member having an open side portion coupled to said second side of said lock core mounting member, and (4) a cover member releasably coupled to said cap member to form a closure for said open side portion, said housing assembly having a plurality of cavities formed therein with said lock core being received within a first of said plurality of cavities;

an alarm circuit disposed within a second of said plurality of cavities, said alarm circuit including an alarm for generating an audible warning signal responsive to an electrical signal, a controller having an output coupled to said alarm for generating said electrical signal responsive to an input signal having a frequency greater than a predetermined frequency, and a piezo film vibration sensor coupled to an input of said controller for providing said input signal responsive to detection of vibration; and, a battery compartment defined by a third of said plurality of cavities and accessible through said open side portion of said cap member, said battery compartment having a partition formed therein and disposed in aligned relationship with said side portion bore of said lock core for mounting a pair of battery contact springs in side-by-side relationship thereon, each said pair of springs extending on opposing sides of said partition for contacting a respective battery on one side of said partition and contact with an end portion of said latch, said contact between said pair of springs and said latch completing an electrical circuit to initiate operation of said controller.

2. The locking device as recited in claim 1 where said controller includes an oscillator for generating said predetermined frequency.

3. The locking device as recited in claim 1 where said controller includes means for periodically automatically testing for a low battery condition and means for providing a low battery warning responsive to detection of a low battery condition.

* * * * *